US006906679B2

(12) United States Patent
Kneisel et al.

(10) Patent No.: US 6,906,679 B2
(45) Date of Patent: Jun. 14, 2005

(54) LIGHT WEIGHT PORTABLE PHASED ARRAY ANTENNA

(75) Inventors: Lawrence Leroy Kneisel, Novi, MI (US); Jay D. Baker, West Bloomfield, MI (US); Bernard A. Meyer, Taylor, MI (US); Andrew Z. Glovatsky, Plymouth, MI (US)

(73) Assignee: Visteon Global Technologies, Inc., VanBuren Township, MI (US)

( * ) Notice: Subject to any disclaimer, the term of this patent is extended or adjusted under 35 U.S.C. 154(b) by 29 days.

(21) Appl. No.: 10/624,040

(22) Filed: Jul. 21, 2003

(65) Prior Publication Data

US 2005/0017920 A1 Jan. 27, 2005

(51) Int. Cl.[7] ..... H01Q 21/00
(52) U.S. Cl. ..... 343/816; 343/880; 343/853
(58) Field of Search ..... 343/795, 909, 343/916, 793, 880–882, 700 MS, 853, 816, 810; 342/368

(56) References Cited

U.S. PATENT DOCUMENTS

| | | | | | |
|---|---|---|---|---|---|
| 4,506,271 | A | * | 3/1985 | Gonzalez | 343/915 |
| 4,891,651 | A | * | 1/1990 | Staehlin et al. | 343/853 |
| 5,307,073 | A | | 4/1994 | Riza | 342/372 |
| 5,333,000 | A | | 7/1994 | Hietala et al. | 342/368 |
| 5,471,200 | A | | 11/1995 | Hammers et al. | 342/372 |
| 5,583,516 | A | * | 12/1996 | Lembo | 342/375 |
| 5,751,242 | A | | 5/1998 | Goutzoulis et al. | 342/158 |
| 6,188,808 | B1 | | 2/2001 | Zhou et al. | 385/3 |
| 6,396,456 | B1 | * | 5/2002 | Chiang et al. | 343/795 |
| 6,426,721 | B1 | | 7/2002 | Obara | 342/375 |
| 6,630,912 | B2 | * | 10/2003 | Ehrenberg et al. | 343/882 |
| 2002/0171599 | A1 | | 11/2002 | Palmer et al. | 343/834 |

FOREIGN PATENT DOCUMENTS

| | | |
|---|---|---|
| GB | 2222910 | 3/1990 |
| JP | 2122004 | 8/1989 |
| JP | 7249937 | 9/1995 |
| WO | WO99/34480 | 7/1999 |

* cited by examiner

*Primary Examiner*—Wilson Lee
*Assistant Examiner*—Ephrem Alemu
(74) *Attorney, Agent, or Firm*—Brinks, Hofer, Gilson & Lione

(57) ABSTRACT

An antenna system for receiving communication signals from satellites having plurality of subplates, a plurality of antenna nodes supported on the top surface of each subplate, and an electronic control unit to which the subplates are fixed and aligned and a collapsible support stand fixed to the bottom of the electronic control unit opposite the subplates in which the subplates, electronic control unit and stand interconnect to form an easily assembled lightweight antenna assembly that may be disassembled into easily portable components.

17 Claims, 4 Drawing Sheets

LIGHT WEIGHT PORTABLE PHASED ARRAY ANTENNA

TECHNICAL FIELD

This invention relates generally to an antenna system and in particular to a light weight portable phased array antenna system for receiving high bandwidth signals from satellites.

BACKGROUND

Although antenna systems that use light communication channels in combination with phased array antenna elements have already been implemented, thus far none of these antenna systems have been adapted to form a portable lightweight collapsible unit. Such a configuration is desirable to provide convenient and portable access to movies on demand or internet service for campers, hikers, travelers and others who may find themselves in remote areas where other communication connections are not readily available. The antenna system of the present invention is easily assembled and disassembled and compact for transporting.

SUMMARY

The present invention provides an antenna system for receiving communication signals from satellites, the antenna system having a plate of light channel material that is formed from a plurality of subplates, a plurality of antenna nodes supported on the top surface of each of the subplates, and an electronic control unit to which the subplates are fixed and aligned and a collapsible support stand fixed to the bottom of the electronic control unit opposite the subplates, the subplates, antenna nodes, electronic control unit and stand interconnecting to form a lightweight antenna assembly that may be disassembled into easily portable components.

These and other aspects and advantages of the present invention will become apparent upon reading the following detailed description of the invention in combination with the accompanying drawings.

DETAILED DESCRIPTION

The following description of the preferred embodiments of the inventive system is not intended to limit the inventive system to these preferred embodiments, but rather to enable any person skilled in the art of phased array antenna systems to make and use the inventive system.

Figure 1:
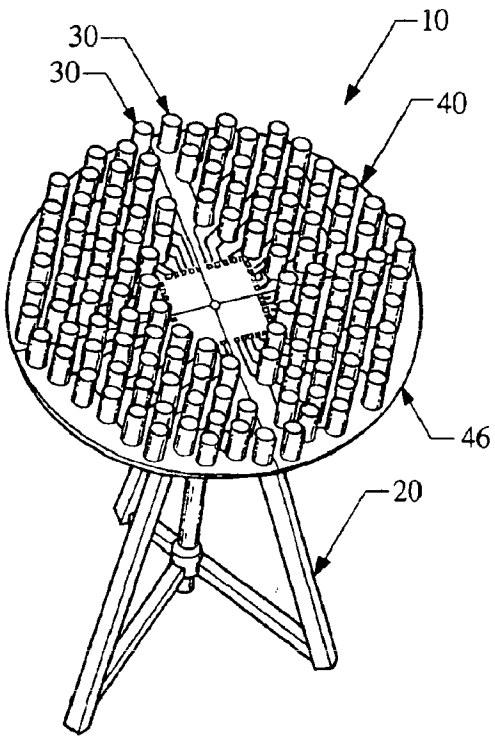
FIG. 1 is a three dimensional graphic representation of a portable light weight phased array antenna assembly.

Referring to FIG. 1, the light weight portable phased array antenna assembly or antenna system 10 for receiving high band width signals from satellites is shown fully assembled and standing upright on its collapsible support stand 20. The preferred embodiment of the antenna system 10 includes a plurality of small dipole antenna elements or antenna nodes 30 that form a phased array 40 for transmitting and receiving signals. Each of the antenna nodes 30 of the phased array 40 is located and supported in a fixed and certain position on a plate 46 of light channel communication (LCC) substrate material.

Figure 2:
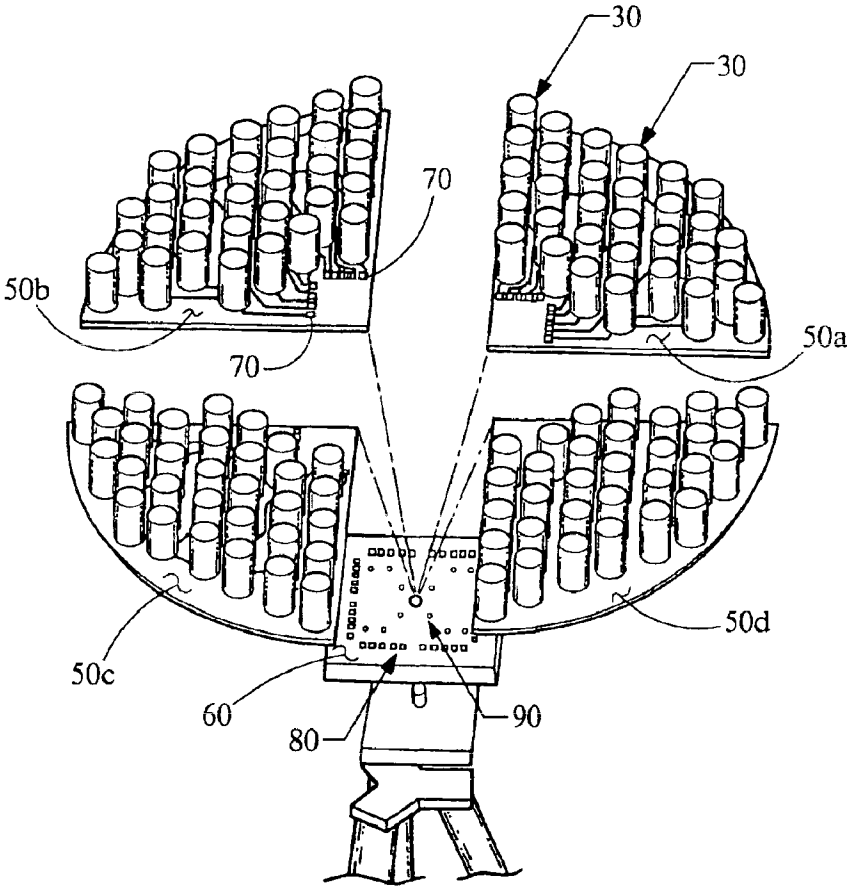
FIG. 2 is a three dimensional exploded view of the antenna assembly showing the electronic control unit and the LCC subplates.

As shown in FIG. 2, the LCC substrate plate 46 in the preferred embodiment is actually made up of four subplates 50*a* through 50*d*, each comprised of LCC substrate material. The LCC substrate plate 46, however, could be made by one skilled in the art using any number of subplates 50.

The LCC substrate plate 46 is detachably fixed to the collapsible support stand 20. The combination of the LCC substrate plate 46 and the detachable and collapsible support stand 20 allows the antenna system 10 to be easily assembled and disassembled into a compact unit for ease in transport. The construction of the LCC substrate plate 46 from the four subplates 50*a* through 50*d* further facilitates the easy transport of the antenna system 10.

Each of the plurality of antenna nodes 30 communicates through one of the LCC subplates 50*a* through 50*d* with a central processor or electronic control unit 60 that combines the incoming signals, calculates deviations among the signals due to differences in the location and direction of the antenna nodes, and sends control signals back to the antenna nodes 30 that allow the timing or delay of some or all of the antenna nodes 30 to be adjusted relative to the others to obtain a synchronized condition among the antenna nodes 30, thus allowing them to process signals in which the phase is synchronized. Use of light channel technology to form the substrate subplates 50*a* through 50*d* makes the preferred embodiment of the inventive antenna system 10 light weight and portable.

The material making up the subplates plates 50*a* through 50*d* in the preferred embodiment is a light-weight light channel communication (LCC) substrate material such as polycarbonate, PETG (glycolized polyester—polyethylene terephtalate with glycol modifiers) or acrylic (polymethyl methacrylate), but its functionality could easily be accomplished through the use of any other strong and light-weight material that is a good conductor of light. The LCC substrate material making up the subplates 50*a* through 50*d* channels or conveys the signal information from each of the antenna nodes 30 to the electronic control unit 60 for data processing. Using the LCC substrate material to comprise the subplates 50*a* through 50*d* eliminates the need for circuit boards or wiring harnesses that can often be large, heavy and bulky.

Figure 3:
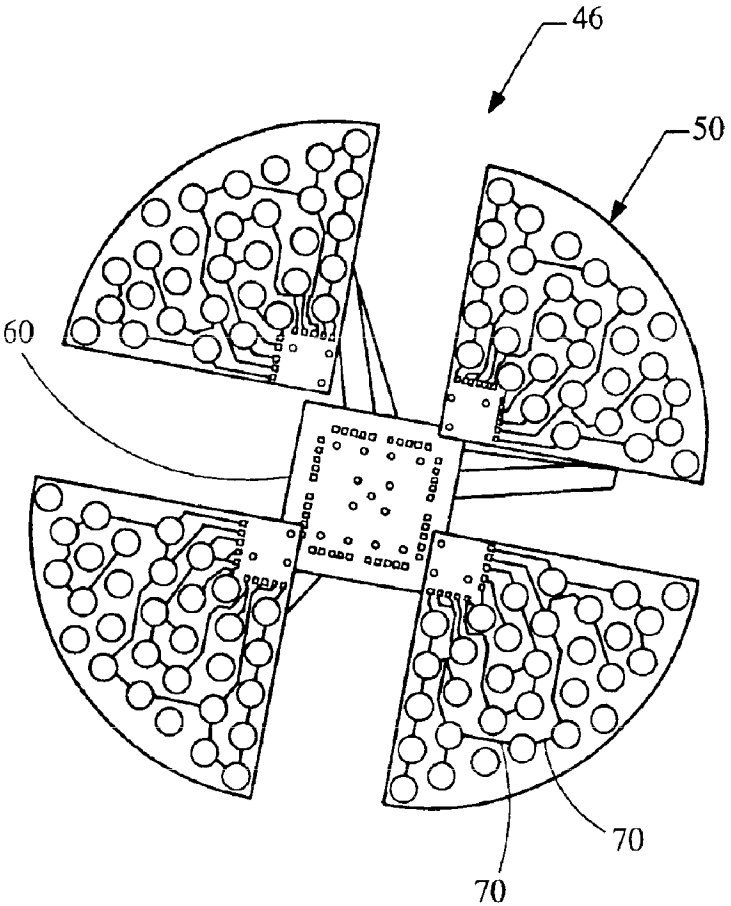
FIG. 3 is an exploded top view of the phased array showing the metal conductors or traces that connect the antenna nodes and the electronic control unit.

As seen in FIG. 3, the LCC substrate material forming the plate 46 and its comprising subplates 50*a* through 50*d* also supports metal conductors or traces 70. The metal conductors or traces are routed to each of the antenna nodes 30 to provide transmission pathways for power. The conductors 70 may be implemented as printed conductive polymer, electroplated traces, flat wire or flexible circuit material that is bonded directly to the LCC material of the subplates 50, or in any of the other ways that are well known to one skilled in the art of antenna systems.

Figure 4:
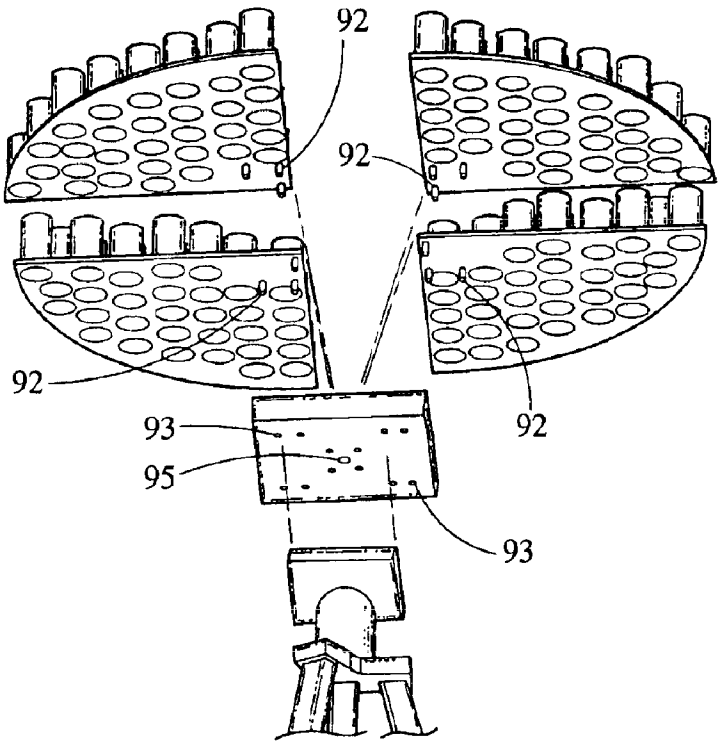
FIG. 4 is an exploded bottom view of the antenna assembly showing the alignment features for the LCC subplates.

As shown in FIG. 2 and FIG. 4, the four separate substrate plates 50*a* through 50*d* of the preferred embodiment are each aligned with and connected to the housing of the electronic control unit 60 to form the complete substrate plate 46 and phased array 40. The alignment features 92 on the back of each subplate 50*a* through 50*d* position and aid in securing each of the subplates 50*a* through 50*d* to the housing of the electronic control unit 60. Each of the alignment features 92 mates with a subplate alignment hole 93 on the housing of the electronic control unit 60 to mechanically align the subplates 50*a* through 50*d*.

Figure 5:
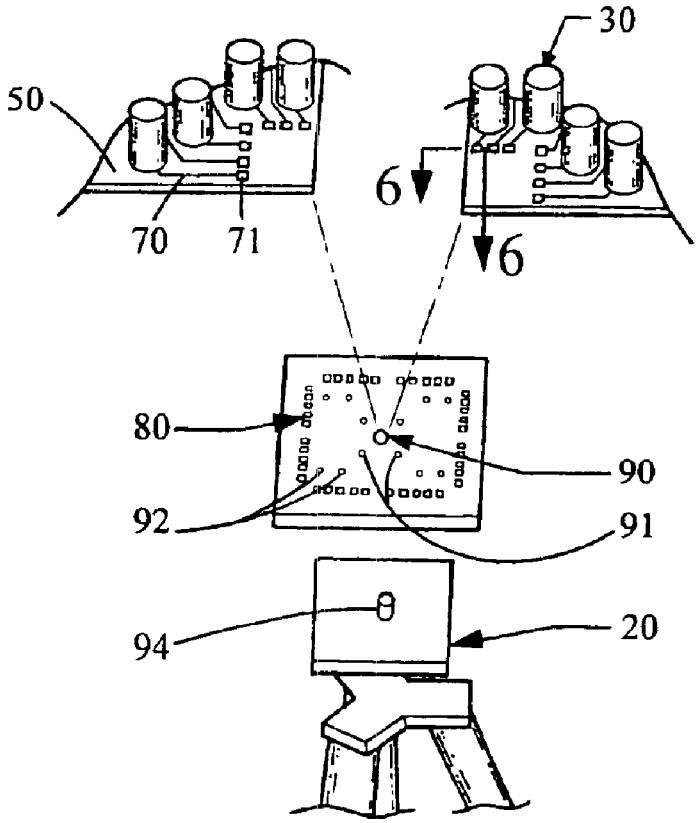
FIG. 5 is an exploded view of the collapsible support stand and the electronic control unit with a partial view of two of the subplates.
Figure 6:
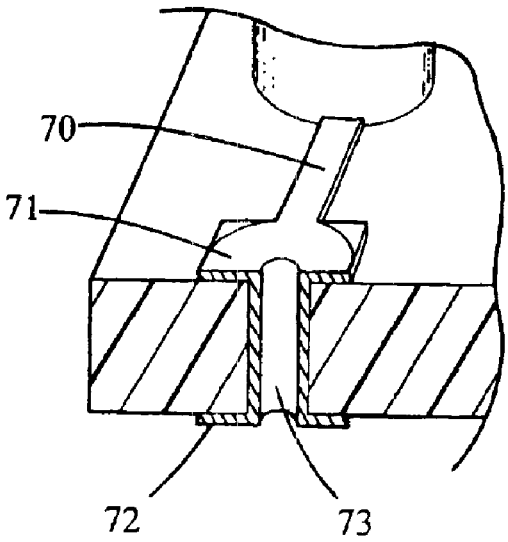
FIG. 6 is a partial cross-sectional view of a subplate taken along section arrows 6—6 of FIG. 5.

Referring now to FIG. 5 and FIG 6, each of the antenna nodes 30 communicates with the main electronic control unit 60 through the optically transparent plate 46. Power is supplied by means of conductive traces or conductors 70 that are routed from each of the antenna nodes 30 to an interconnect pad 71. Each of the interconnect pads 71 is connected to a duplicate interconnect pad 72 on the under side of the LCC subplate 50*a* through 50*d* by means of a copper plated through hole 73. The duplicate interconnect pacts 72 are in turn each connected to one of a plurality of conductor pads 80 embedded in the housing of the electronic control unit 60 using any one of the many known methods of interconnection, such as by way of example, connectors or press fit pins, thereby completing a communications path from each of the antenna nodes 30 to the electronic control unit 60 that processes the signal data. The electronic control unit 60 is located and secured to the collapsible support stand 20 through means of a central locator pin 94 that mates with a central alignment hole 95 in the housing of the electronic control unit 60

Also shown in FIG 5 is an emitter/transmitter LED 90 that transmits signals from the electronic control unit 60 to the plurality of antenna nodes 30 that form the phased array 40. Conversely, photoreceptors or other receiver devices 91 receive signals from the plurality of antenna nodes 30 in the phased array 40 and convey these signals to the electronic control unit 60.

Figure 7:
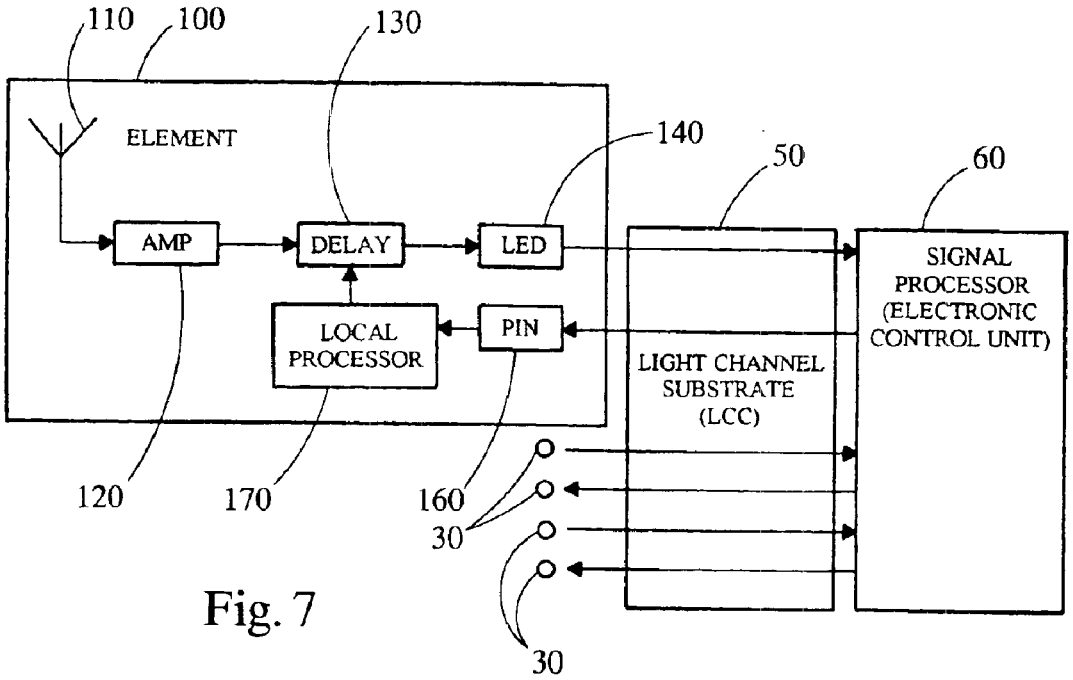
FIG. 7 is a functional block diagram depicting the operation of one of the antenna's nodes in receiving mode.
Figure 8:
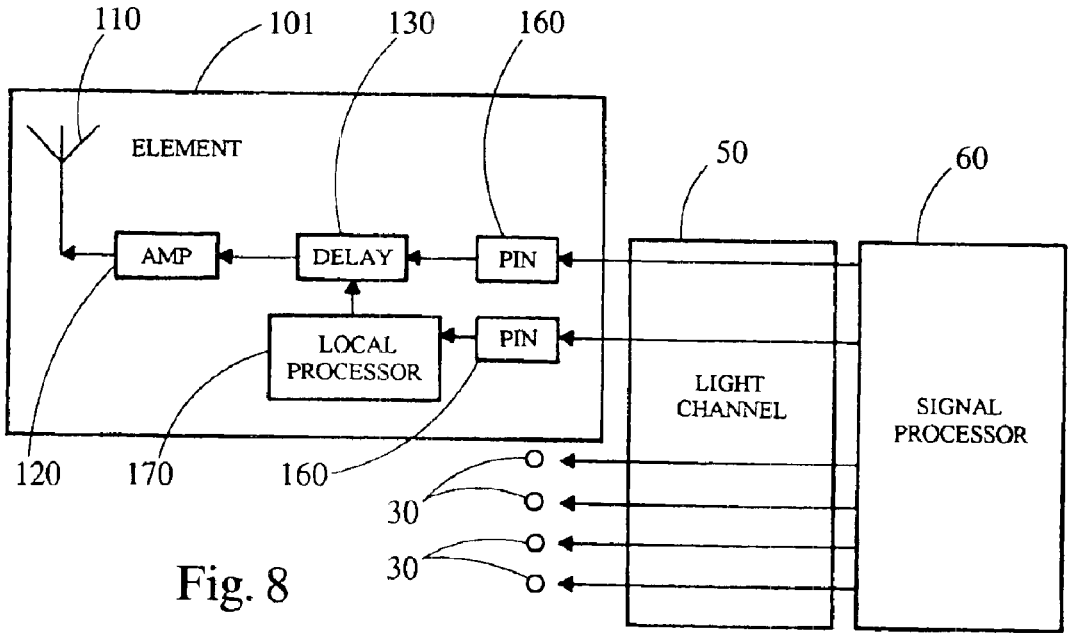
FIG. 8 is a functional block diagram depicting the operation of one of the antenna's nodes in transmitting mode.

The node electronics 100, 101 shown in FIG. 7 and FIG. 8 are provided for each of the antenna nodes 30 in the phased array 40. The node electronics 100, 101 functionally support the transmitting and receiving functions of its respective antenna node 30 and are preferably contained in the respective antenna node 30, but alternatively could be attached on, to or near a corresponding conductor 70 on the LCC subplates 50.

Referring now to FIG. 7, each of the receiving node electronics 100 consists of a dipole element 110 attached to a low noise amplifier 120, which in turn feeds a programmable phase delay element 130. The output of the phase delay element 130 modules the output of a light emitting or laser diode 140 that is coupled to the LCC material of the subplate 50. The light is gathered and combined at the receiver devices 91, which couple the signal to detector/demodulation circuits within the electronic control unit 60. The electronic control unit 60 processes the signal to produce the resultant broadband signal.

A local processor 170 within the receiving node electronics 100 receives signals from the electronics control unit 60 via a pin 160 within the receiving node electronics 100. The local processor 170 calculates the appropriate delays for the dipole element 110 and modulates an LED/transceiver to send that information back to the appropriate antenna nodes 30 in the phased array 40 in order to adjust the delay of each of the antenna nodes 30 as needed to achieve synchronization of the phased array 40. The adjustment in the delay of the antenna nodes 30 is controlled by microprocessor controlled phase delay lines contained in the electronic control unit 60.

Referring to FIG. 6, the transmit function of the node electronics 101 is shown to operate in manner that is similar to the receiving function of the node electronics 100 depicted in FIG. 5. The main electronic control unit 60 sends signals via the LCC subplates 50 to each of the antenna nodes 30 providing the delay information to point the antenna system's 10 substrate plate 46 and phased array 40 in the correct direction. The transmit signal is also conveyed to a transmit antenna node 30 where it is delayed, amplified and conducted to the dipole element.

The preceding description of the preferred embodiments of the inventive system is not intended to limit the inventive system to these preferred embodiments, but rather to enable any person skilled in the art of phased array antenna systems to make and use this invention. As any person skilled in the art of phased array antenna systems will recognize from the previous detailed description and from the figures and claims, modifications and changes could be made to the preferred embodiments of the inventive system without departing from the scope of this invention system defined in the following claims.

We claim:

1. An apparatus for receiving communication signals from satellites, comprising:

a plate of light channel material formed from a plurality of aligned subplates, the plate and each of the subplates having a top surface and a bottom surface;

a plurality of antenna nodes supported on the top surface of each of the subplates of the plate;

a support stand detachably fixed to the bottom surface of the plate;

an electronic control unit at least one of the antenna nodes in the plurality of antenna nodes communicating through the pate of light channel material with the electronic control unit;

wherein the plate, the plurality of antenna nodes, the electronic control unit, and the support stand interconnect to form a lightweight portable antenna assembly that is easily disassembled.

2. An apparatus for receiving communication signals from satellites, comprising:

a plate of light channel material formed from a plurality of aligned subplates, each of the subplates having a top surface and a bottom surface;

a plurality of antenna nodes supported on the top surface of each of the subplates;

an electronic control unit contained in a housing that has a bottom surface, at least one of the antenna nodes in the plurality of antenna nodes communicating through the plate of light channel material with the electronic control unit;

a collapsible support stand detachably fixed to the bottom surface of the housing;

wherein the plate with the plurality of antenna nodes, the electronic control unit, and the support stand interconnect to form a lightweight antenna assembly that may be disassembled into easly portable components.

3. An apparatus for receiving communication signals from satellites, comprising:

a plate of light channel material, the plate having a top surface and a bottom surface, the plate being formed from a plurality of subplates formed of light channel material;

a plurality of antenna nodes supported on the top surface of the plate;

a support stand detachably attached to the bottom surface of the plate, the support stand having an electronic control unit detachably attached to the bottom side of the plate;

wherein the plate, the plurality of antenna nodes, and the support stand interconnect to form a lightweight portable antenna assembly.

4. The apparatus of claim 3, further comprising an alignment feature connected to each of the plurality of subplates, the alignment feature providing means to align the subplate with the electronic control unit.

5. An apparatus for receiving communication signals from satellites, comprising:

a plate of light channel material formed from a plurality of aligned subplates, the plate and each of the subplates having a top surface and a bottom surface;

a plurality of antenna nodes supported on the top surface of the subplates;

a support stand detachably attached to the bottom surface of the plate;

wherein the plate, the plurality of antenna nodes, and the support stand interconnect to form a lightweight portable antenna assembly.

6. The apparatus of claim 5, wherein each of the antenna nodes in the plurality of antenna nodes is located in a known position or the plate.

7. The apparatus of claim 5, wherein at least two of the antenna nodes in the plurality of antenna nodes is a dipole antenna element, the plurality of antenna nodes collectively forming a phased array for transmitting and receiving signals.

8. The apparatus of claim 5, wherein the support stand is collapsible.

9. The apparatus of claim 5, wherein the light channel material is a material that is capable of conveying communication signals in the form of light.

10. The apparatus of claim 5, wherein the light channel material is a polycarbonate material.

11. The apparatus of claim 5, wherein the light channel material is a gylcolized polyester material.

12. The apparatus of claim 5, wherein the light channel material is an acrylic material.

13. The apparatus of claim 5, further comprising at least one conductor supported by the plate, said conductor providing a power transmission pathway.

14. The apparatus of claim 13, further comprising an interconnection pad, wherein the conductor is routed from the antenna node to the interconnect pad.

15. The apparatus of claim 5, wherein the support stand further comprises an electronic control unit detachably attached to the bottom side of the plate.

16. The apparatus of claim 15, wherein at least one of the antenna nodes in the plurality of antenna nodes communicates through the plate of light channel material with the electronic control unit.

17. The apparatus of claim 15, each of the antenna nodes further comprising a phase delay element adaptable to affect a delay in a communication signal wherein the electronic control unit combines the signal from each of at least two of the antenna nodes and calculates a deviation between the signals to produce a control signal that allows the delay of at least one of the antenna nodes to be adjusted.

* * * * *